US009421776B2

(12) United States Patent
Somete

(10) Patent No.: US 9,421,776 B2
(45) Date of Patent: Aug. 23, 2016

(54) RECOVERY SYSTEM FOR RECORDING HEAD AND INK-JET RECORDING APPARATUS INCLUDING THE SAME

(71) Applicant: KYOCERA Document Solutions Inc., Osaka (JP)

(72) Inventor: Takashi Somete, Osaska (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/961,253

(22) Filed: Dec. 7, 2015

(65) Prior Publication Data

US 2016/0185121 A1 Jun. 30, 2016

(30) Foreign Application Priority Data

Dec. 26, 2014 (JP) ..... 2014-263990

(51) Int. Cl.
*B41J 2/165* (2006.01)

(52) U.S. Cl.
CPC ..... *B41J 2/16535* (2013.01)

(58) Field of Classification Search
CPC ..... B41J 2/16535; B41J 2/16538; B41J 2/16541; B41J 2/16547; B41J 2/16585
USPC ..... 347/33
See application file for complete search history.

(56) References Cited

U.S. PATENT DOCUMENTS

2002/0109744 A1* 8/2002 Shindo ..... B41J 2/1433 347/23
2008/0049066 A1* 2/2008 Inoue ..... B41J 2/16538 347/33
2013/0135385 A1* 5/2013 Kanzaki ..... B41J 2/16526 347/33

FOREIGN PATENT DOCUMENTS

JP 2013-49205 A 3/2013

* cited by examiner

*Primary Examiner* — Manish S Shah
*Assistant Examiner* — Roger W Pisha, II
(74) *Attorney, Agent, or Firm* — Stein IP, LLC

(57) ABSTRACT

A recovery system for a recording head according to the present disclosure includes a wiper, a drive mechanism, and a control portion. The control portion is able to execute a recovery operation for a recording head that includes a first ink pushing-out operation that forcibly pushes out ink, a first wiping operation that wipes away purged ink, and a second wiping operation that moves the wiper in a direction opposite to the first direction. The wiper includes a first wiping surface, a second wiping surface, and an upper surface. The upper surface is provided with a first step portion that becomes higher from a first upper end portion of the first wiping surface to a second upper end portion of the second wiping surface.

9 Claims, 20 Drawing Sheets

RECOVERY SYSTEM FOR RECORDING HEAD AND INK-JET RECORDING APPARATUS INCLUDING THE SAME

INCORPORATION BY REFERENCE

The present application is based on Japanese Patent Application No. 2014-263990 filed on Dec. 26, 2014, the contents of which are hereby incorporated by reference.

BACKGROUND

The present disclosure relates to an ink-jet recording apparatus that performs recording by ejecting ink onto a recording medium such as a paper sheet, more particularly, to: a recovery system for a recording head that forcibly pushes out ink from an ejecting nozzle of the recording head, thereafter, wipes away the purged ink adhering to an ink ejecting surface by means of a wiper; and to an ink-jet recording apparatus that includes the recovery system.

As recording apparatuses such as a facsimile, a copy machine, a printer, ink-jet recording apparatuses which form an image by ejecting ink are widely used because they can form a high-definition image.

In such ink-jet recording apparatuses, there is a case where deterioration (curved fly) in linear traveling of ink, failed ink ejection and the like occur and printing performance of the recording head declines. As a cause of this, occurrence of a meniscus trouble is conceivable which is caused by that foreign mater such as paper powder, dust and debris occurring during a sheet (recording medium) conveyance time, a minuscule ink drop (hereinafter, called a mist) ejected along with an ink drop for image recording, and a bouncing mist, which occurs when the ink drop adheres to the recording medium, adheres to the ink ejecting surface of the recording head. Besides, decline in sealing performance during a cap mounting time caused by that the mist adheres to a cap mounting place and dries and occurrence of increased viscosity of the ink in the nozzle due to the sealing performance decline are also conceivable.

Because of this, a structure is used, in which to prevent: the drying of ink in the ejecting nozzle whose opening is formed through the ink ejecting surface of the recording head; and clogging of the nozzle caused by the thickened ink in the ejecting nozzle, the ink is forcibly pushed out (purged) from the nozzle, thereafter, the purged ink adhering to the ink ejecting surface (nozzle surface) is wiped away by means of a wiper to perform a recording head recovery process.

For example, a method is known, in which a wiper is pressed at a predetermined contact pressure against a portion of an ink ejecting surface of a recording head, where there is not a nozzle, to clean the ink ejecting surface. Specifically, as shown in FIG. 35A, a wiper 103 is pressed substantially perpendicularly to a region (wiping start position) outside a nozzle region 102, where ejecting nozzles are disposed, of an ink ejecting surface 101*a* of a recording head 101. Next, as shown in FIG. 35B, FIG. 35C, the wiper 103 is horizontally moved along the ink ejecting surface 101*a* in an arrow A direction to wipe away ink 104 on the nozzle region 102, and as shown in FIG. 35D, after the wiper 103 is made to leave the ink ejecting surface 101*a*, the wiper 103 is horizontally moved in an arrow A' direction and returned to the wiping start position.

But, according to the method shown in FIG. 35A to FIG. 35D, as shown in FIG. 36A, inks 104*a*, 104*b* respectively adhere to a side surface and tip end of the wiper 103 during a second wiping time. The inks 104*a*, 104*b* adhering to the side surface and tip end of the wiper 103 are exposed to air to become high in viscosity, and adhere to the ink ejecting surface 101*a* as shown in FIG. 36B and FIG. 36C.

As described above, the wiping operation is repeated, whereby the ink 104*b* collects gradually near the wiping start position to form a large ink puddle. And, there is a disadvantage that this ink puddle falls on or contact the recording medium passing under the ink ejecting surface 101*a* to dirty a print surface.

To improve the disadvantage, a wiping mechanism for an ink-jet recording apparatus is known, which has two wipers that can successively contact the ink ejecting surface of the recording head wherein the preceding wiper wipes away the purged ink and the following wiper wipes away ink that remains near a wiping start position of the preceding wiper.

SUMMARY

A recovery system for a recording head according to an aspect of the present disclosure is a recovery system for a recording head that is provided with a nozzle region from which an ejecting nozzle for ejecting ink onto a recording medium is opened, and which includes a wiper, a drive mechanism, and a control portion. The wiper wipes away purged ink that is forcibly pushed out from the ejecting nozzle. The drive mechanism reciprocates the wiper along an ink ejecting surface that includes the nozzle region. The control portion controls the pushing-out and ejection of the ink from the ejecting nozzle and the operation of the drive mechanism. The control portion is able to execute a recording head recovery operation that includes: a first ink pushing-out operation that forcibly pushes out the ink from the ejecting nozzle and makes the purged ink adhere to the nozzle region; a first wiping operation that presses the wiper against a first position outside the nozzle region of the ink ejecting surface, thereafter, moves the wiper to the nozzle region in a first direction along the ink ejecting surface with the wiper pressed against the ink ejecting surface, thereby wipes away the purged ink, and moves the wiper to a second position opposite to the first position with respect to the nozzle region; and a second wiping operation that moves the wiper from a position opposite to the first position with respect to the nozzle region to a position on the first position side with respect to the nozzle region with the wiper pressed against the ink ejecting surface. The wiper includes: a first wiping surface disposed to face in the first direction; a second wiping surface disposed to face in a second direction opposite to the first direction; and an upper surface disposed between the first wiping surface and the second wiping surface. The first wiping surface includes a first upper end portion that contacts the ink ejecting surface when the wiper moves in the first direction in the first wiping operation, the second wiping surface includes a second upper end portion that contacts the ink ejecting surface when the wiper moves in the second direction in the second wiping operation, and the upper surface is provided with a convex portion, which is rectangular in a side view, between the first upper end portion and the second upper end portion, and provided with a first step portion, which becomes higher from the first upper end portion to the second upper end portion, between the first upper end portion and the convex portion.

Still other objects of the present disclosure and specific advantages obtained by the present disclosure will become more apparent from the following description of embodiments.

DETAILED DESCRIPTION

Hereinafter, embodiments of the present disclosure are described with reference to the drawings.

(First Embodiment)

Figure 1:
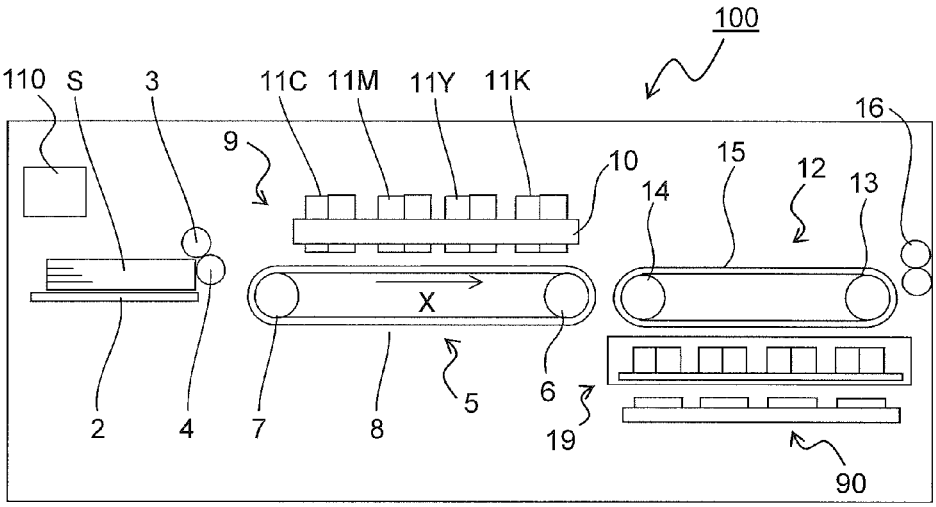
FIG. 1 is a view showing a structure of an ink-jet recording apparatus according to a first embodiment of the present disclosure.

As shown in FIG. 1, a sheet feeding tray 2 storing paper sheets S (recording media) is disposed in a left portion of an ink-jet recording apparatus 100 according to a first embodiment of the present disclosure. One end of the sheet feeding tray 2 is provided with a sheet feeding roller 3, which feeds the sheets S stored in the sheet feeding tray 2 one after another beginning with the uppermost sheet S to a first conveyance unit 5 described later, and a driven roller 4 that is pressed against the sheet feeding roller 3 and driven to rotate.

The first conveyance unit 5 and a recording portion 9 are disposed downstream (right of FIG. 1) from the sheet feeding roller 3 and driven roller 4 with respect to a sheet conveyance direction (arrow X direction). The first conveyance unit 5 has a structure which includes a first drive roller 6, a first driven roller 7, and a first conveyance belt 8 mounted on the first drive roller 6 and first driven roller 7, wherein the first drive roller 6 is driven to rotate in a clockwise direction based on a control signal from a control portion 110 of the ink-jet recording apparatus 100, whereby the sheet S held by the first conveyance belt 8 is conveyed in the arrow X direction.

Figure 2:
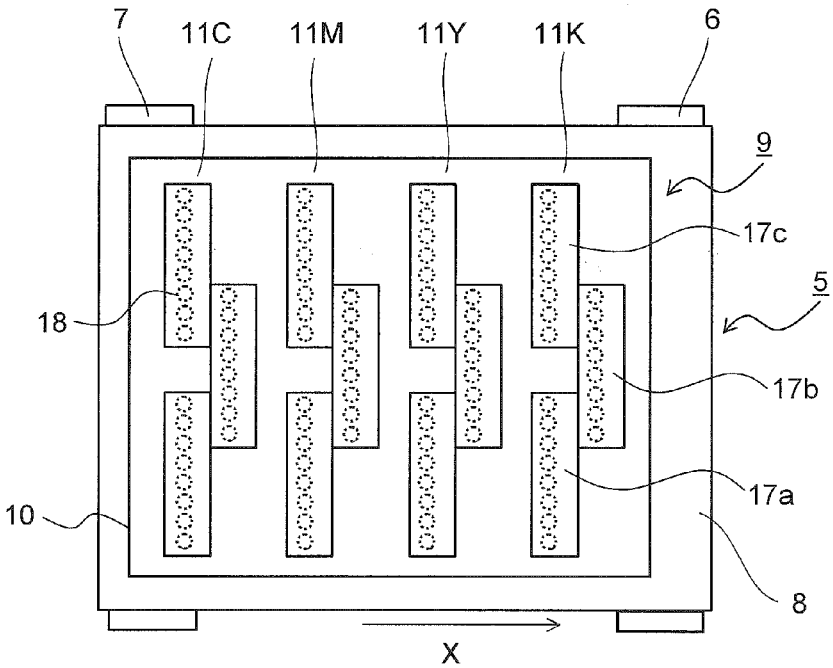
FIG. 2 is a view of a first conveyance unit and a recording portion of the ink-jet recording apparatus shown in FIG. 1 seen from above.
Figure 3:
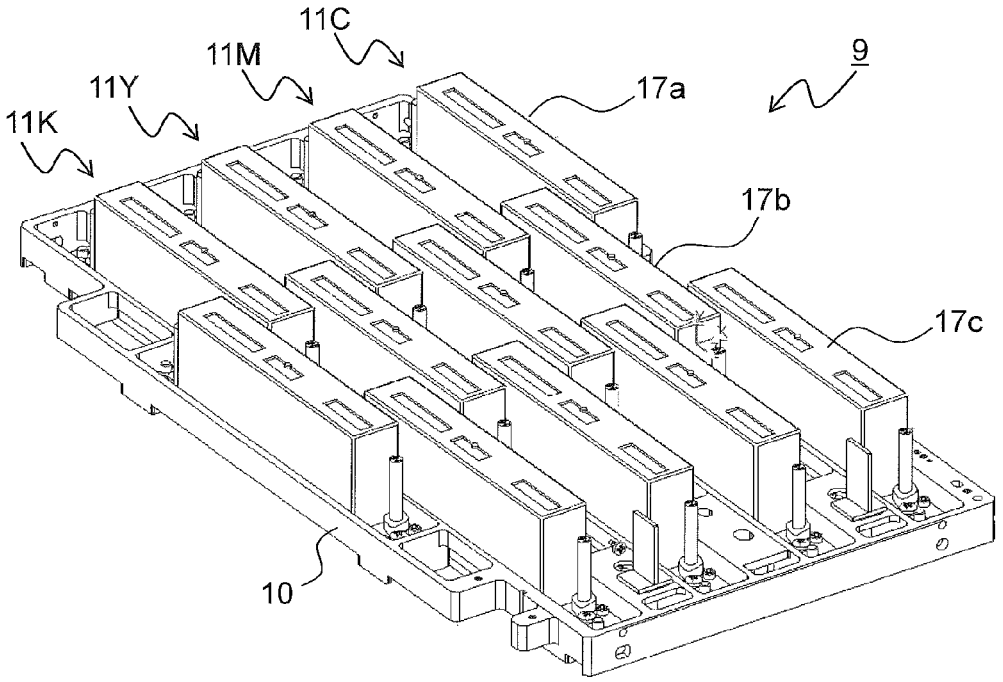
FIG. 3 is a view of the recording portion seen from diagonally above.

The recording portion 9 includes a head housing 10, line heads 11C, 11M, 11Y, and 11K which are held by the head housing 10. These line heads 11C to 11K are supported at a height to form a predetermined distance (e.g., 1 mm) from a conveyance surface of the first conveyance belt 8, and as shown in FIG. 2 and FIG. 3, a plurality of recording heads 17*a* to 17*c* (here, three) are arranged in a staggering pattern along a sheet width direction (vertical direction of FIG. 2) perpendicular to the sheet conveyance direction. In the meantime, FIG. 3 shows a state of the recording portion 9 seen from behind FIG. 1 (above FIG. 2), and the arrangement of the line heads 11C to 11K is reverse in FIG. 1 and FIG. 2.

Figure 4:
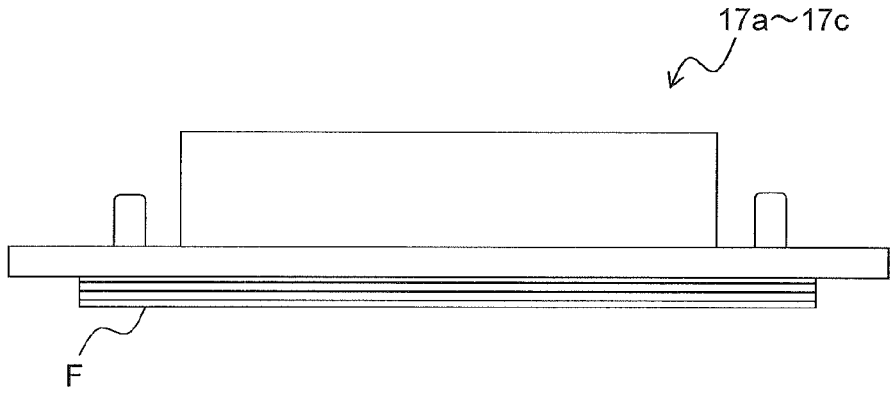
FIG. 4 is a view of a recording head that composes a line head of the recording portion.
Figure 5:
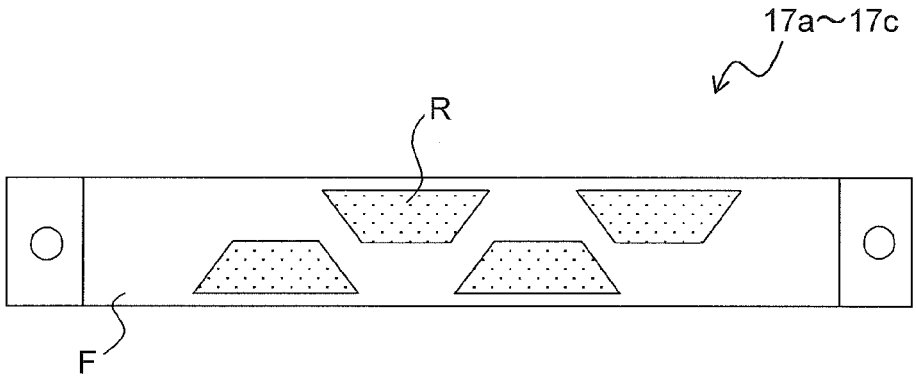
FIG. 5 is a view of the recording head seen from an ink ejecting surface side.

As shown in FIG. 4 and FIG. 5, ink ejecting surfaces F of the recording heads 17*a* to 17*c* are each provided with nozzle regions R where many ejecting nozzles 18 (see FIG. 2) are arranged. In the meantime, the recording heads 17*a* to 17*c* have the same shape and structure. Accordingly, in FIG. 4 and FIG. 5, one drawing represents the recording heads 17*a* to 17*c*.

The recording heads 17*a* to 17*c* composing each line head 11C to 11K are supplied with four color inks (cyan, magenta, yellow, and black) stored in respective ink tanks (not shown) corresponding to the respective line heads 11C to 11K.

By means of control signals from the control portion 110 (see FIG. 1), each recording head 17*a* to 17*c* ejects ink, in accordance with image data received from an external computer, from the ink ejecting nozzles 18 to the sheet S that is attracted and held on the conveyance surface of the first conveyance belt 18. In this way, the four color inks of cyan, magenta, yellow and black are superimposed, whereby a color image is formed on the sheet S on the sheet conveyance belt 8.

Besides, to prevent defective ink ejection caused by drying or clogging of the recording heads 17*a* to 17*c*, when starting a print operation after a long period suspension, a purge is executed to push out thickened ink from the ejecting nozzles 18 of all the recording heads 17*a* to 17*c*, and between the print operations, a purge is executed to push out thickened ink present in the ejecting nozzles 18 from the ejecting nozzles 18 of some of the recording heads 17*a* to 17*c* whose ink ejecting amount is less than a predetermined value, thereby preparing for the next print operation.

Back to FIG. 1, a second conveyance unit 12 is disposed downstream (right of FIG. 1) from the first conveyance unit 5 in the sheet conveyance direction. The second conveyance unit 12 includes a second drive roller 13, a second driven roller 14, and a second conveyance belt 15 mounted on the second drive roller 13 and second driven roller 14, wherein the second drive roller 13 is driven to rotate in a clockwise direction, whereby the sheet S held by the second conveyance belt 15 is conveyed in the arrow X direction.

The sheet S on which an ink image is formed by the recording portion 9 is conveyed to the second conveyance unit 12, and during passing through the second conveyance unit 12, the ink ejected to the sheet S surface is dried. Besides, a maintenance unit 19 and a cap unit 90 are disposed under the second conveyance unit 12. When performing the above purge, the maintenance unit 19 moves under the recording portion 9, wipes away the ink which is pushed out from the ink ejecting nozzles 18 of the recording heads 17*a* to 17*c* and adheres to the ink ejecting surface F, and collects the wiped ink. When capping the ink ejecting surface F (see FIG. 4) of the recording heads 17*a* to 17*c*, the cap unit 90 horizontally moves under the recording portion 9, further, moves upward to be mounted on a lower surface of the recording heads 17*a* to 17*c*. In the meantime, a detailed structure of the maintenance unit 19 is described later.

Besides, a delivery roller pair 16, which delivers the sheet S on which an image is recorded to outside an apparatus main body, is disposed downstream from the second conveyance unit 12 with respect to the sheet conveyance direction, and a delivery tray (not shown), in which the sheet S delivered to outside the apparatus main body is loaded, is disposed downstream from the delivery roller pair 16.

Figure 6:
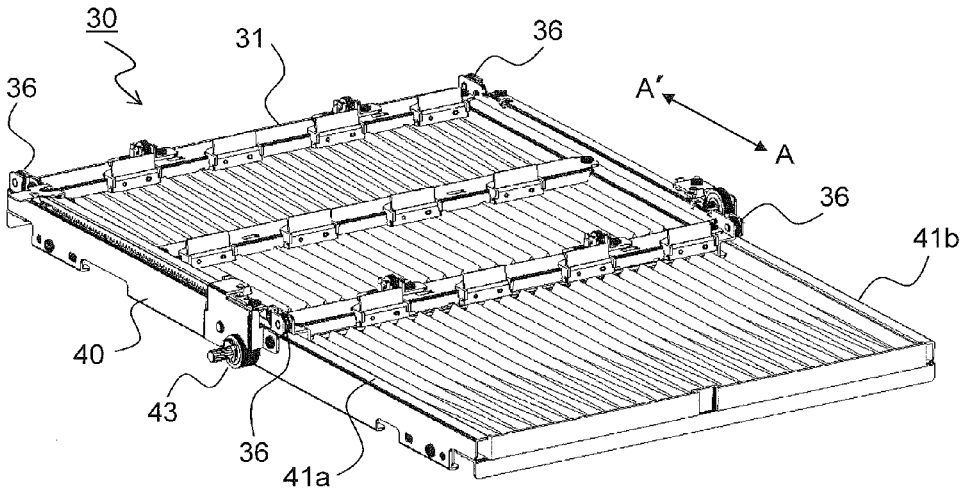
FIG. 6 is a view of a wiping mechanism incorporated in a maintenance unit seen from diagonally above.

The maintenance unit 19 is mounted with a wiping mechanism 30 shown in FIG. 6. The wiping mechanism 30 is composed of a substantially rectangular carriage 31 to which a plurality of wipers 35*a* to 35*c* (see FIG. 7) are fixed, and a support frame 40 that supports the carriage 31. Rail portions 41*a*, 41*b* are formed on opposing end edges of an upper surface of the support frame 40, and slide rollers 36 disposed at four corners of the carriage 31 abut the rail portions 41*a*, 41*b*, whereby the carriage 31 is supported slidably in an arrow AA' direction with respect to the support frame 40.

Figure 7:
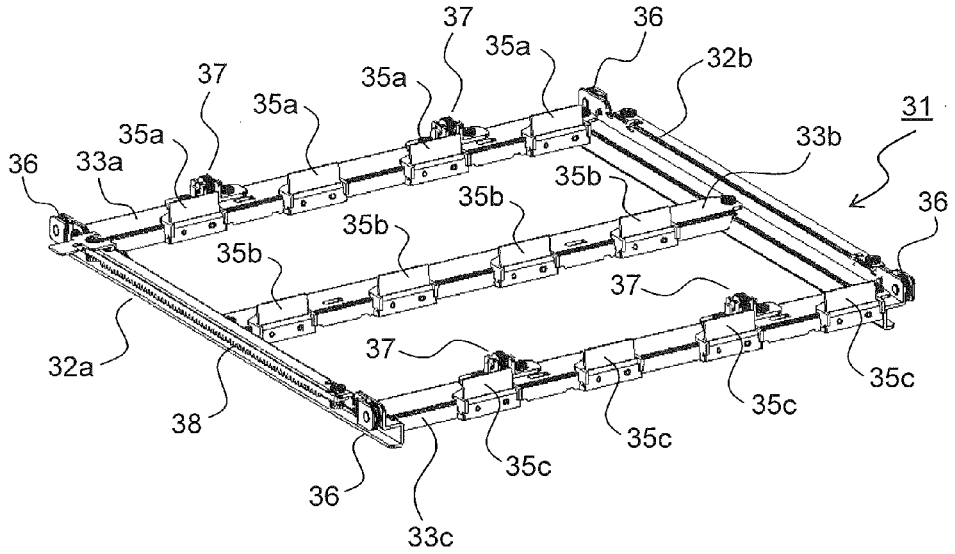
FIG. 7 is a view of a carriage composing the wiping mechanism seen from diagonally above.

As shown in FIG. 7, the carriage 31 is formed into a frame shape by first stays 32*a*, 32*b* that slidably engage with the rail portions 41*a*, 41*b* of the support frame 40 via the slide rollers 36, and second stays 33*a*, 33*b*, and 33*c* that are fixed between the first stays 32*a*, 32*b* like bridges.

The first stay 32*a* is provided with rack teeth 38 that mesh with an input gear 43 (see FIG. 6) held by the support frame 40. When the input gear 43 rotates in forward and backward directions, the carriage 31 reciprocates in a horizontal direction (arrow AA' direction of FIG. 6) along the support frame 40. In the meantime, a drive mechanism of the present disclosure is composed of the rack teeth 38 and the input gear 43.

The wipers 35*a* to 35*c* are members that wipe away the ink pushed out from the ejecting nozzles 18 of the respective recording heads 17*a* to 17*c*. The wipers 35*a* to 35*c* are pressed from substantially vertical directions against positions outside the nozzle region R (see FIG. 5) from which nozzle surfaces of the ejecting nozzles 18 are exposed, and clean the ink ejecting surface F including the nozzle region R in a predetermined direction (arrow AA' direction of FIG. 6) in accordance with the movement of the carriage 31.

Four wipers 35*a* are fixed to the second stay 33*a* at substantially equal intervals, likewise, four wipers 35*b* are fixed to the second stay 33*b* at substantially equal intervals, and four wipers 35*c* are fixed to the second stay 33*c* at substantially equal intervals. The wipers 35*a*, 35*c* are respectively disposed at positions corresponding to the left and right recording heads 17*a*, 17*c* (see FIG. 3) that compose each line head 11 C to 11K. Besides, the wiper 35*b* is disposed at a position corresponding to the central recording head 17*b* (see FIG. 3) that composes each line head 11 C to 11K, is deviated and fixed a predetermined distance away from the wipers 35*a*, 35*c* in a direction perpendicular to the movement direction (arrow AA' direction of FIG. 6) of the carriage 31.

Figure 8:
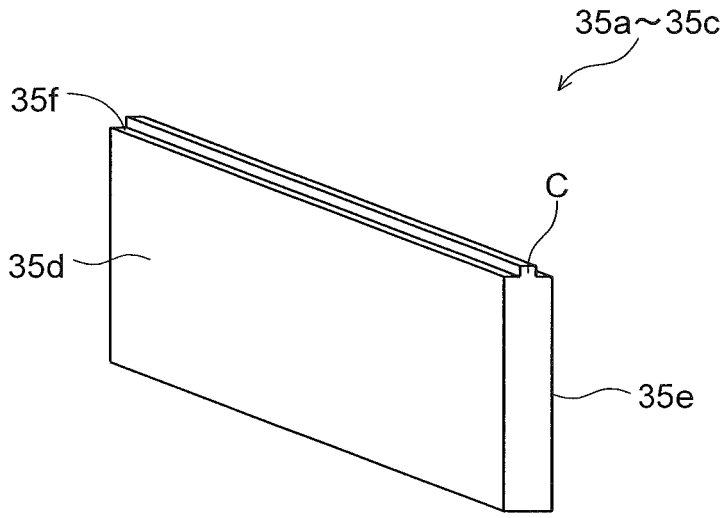
FIG. 8 is a view showing a structure of a wiper.
Figure 9:
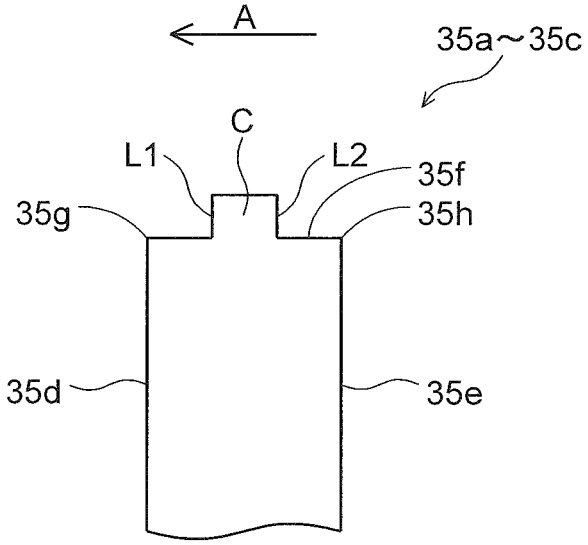
FIG. 9 is a view showing a structure of a wiper upper portion seen from a wiper width direction.

As shown in FIG. 8 and FIG. 9, each wiper 35*a* to 35*c* includes: a first wiping surface 35*d* that is disposed to face in the A direction (first direction); a second wiping surface 35*e* that is disposed to face in a direction (second direction) opposite to the A direction; and an upper surface 35*f* that is disposed between the first wiping surface 35*d* and the second wiping surface 35*e*.

The first wiping surface 35*d* wipes away purged ink 22*b* (see FIG. 18), which is pushed out by a first ink pushing-out operation described later, during a first wiping operation time described later. A first upper end portion 35*g* of the first wiping surface 35*d* is pressed against the ink ejecting surface F when the wipers 35*a* to 35*c* move in the arrow A direction in the first wiping operation.

The second wiping surface 35*e* wipes away purged ink 22*c* (see FIG. 25), which is pushed out by a second ink pushing-out operation described later, during a second wiping operation time described later. A second upper end portion 35*h* of the second wiping surface 35*e* is pressed against the ink ejecting surface F when the wipers 35*a* to 35*c* move in a direction (arrow A' direction) opposite to the arrow A direction in the second wiping operation.

The upper surface 35*f* is provided with a convex portion C, which protrudes upward and is rectangular in a side view, between the first upper end portion 35*g* and the second upper end portion 35*h*. A first step portion L1, which becomes higher (rises) in a direction from the first upper end portion 35*g* to the second upper end portion 35*h*, is formed between the first upper end portion 35*g* and the convex portion C, and a second step portion L2, which becomes lower (declines) in the direction from the first upper end portion 35*g* to the second upper end portion 35*h*, is formed between the convex portion C and the second upper end portion 35*h*. In the meantime, the convex portion C (first step portion L1, second step portion L2) does not contact the ink ejecting surface F when the wipers 35*a* to 35*c* move in the arrow AA' direction in the first wiping operation and second wiping operation that are described later.

For example, the wipers 35*a* to 35*c* are each formed to have a width of about 2.5 mm when seeing from the arrow A direction and a width (distance between the first wiping surface 35*d* and the second wiping surface 35*e*) of about 1.0 mm in a cross-sectional view. Besides, the convex portion C is formed into a square that has an edge length of about 0.5 mm in a cross-sectional view.

As shown in FIG. 7, gap rollers 37 are dispose at four positions of upper surfaces of the second stays 33*a*, 33*c*. When the wiping mechanism 30 is stepped up toward the recording portion 9 to perform the wiping operation for the ink ejecting surface F of the recording heads 17*a* to 17*c* by means of the wipers 35*a* to 35*c*, the gap rollers 37 abut the head housing 10 of the recording portion 9 to keep a contact state of the wipers 35*a* to 35*c* with the ink ejecting surface F constant.

Figure 10:
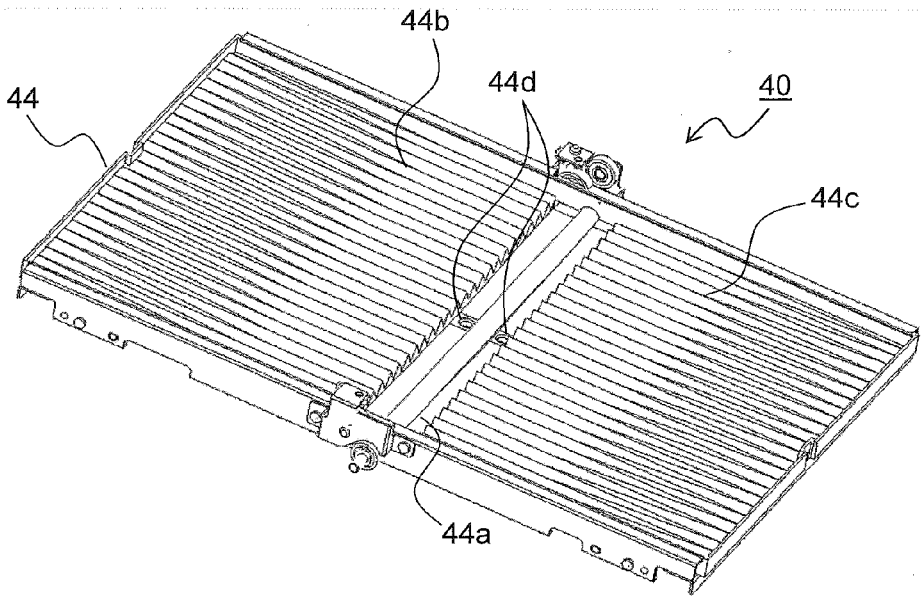
FIG. 10 is a view showing a support frame composing the wiping mechanism seen from diagonally above.

As shown in FIG. 10, the upper surface of the support frame 40 is provided with an ink collection tray 44 for collecting the wasted ink that is wiped away from the ink ejecting surface F by the wipers 35*a* to 35*c*. At a substantially central portion of the ink collection tray 44, a groove portion 44*a* is formed along an extension direction of the second stays 33*a* to 33*c*, and tray surfaces 44*b*, 44*c* on both sides of the groove portion 44*a* have a descending gradient toward the groove portion 44*a*. The groove portion 44*a* is provided therein with ink discharging holes 44*d*, and a bottom surface of the groove portion 44*a* has a descending gradient toward the ink discharging holes 44*d*.

The wasted ink, which is wiped away from the ink ejecting surface F by the wipers 35*a* to 35*c* and falls to the tray surfaces 44*b* and 44*c*, is collected in the groove portion 44*a*, further, flows in the groove portion 44*a* to the ink discharging holes 44*d*. Thereafter, the wasted ink is collected by a wasted ink collection tank (not shown) via an ink collection path (not shown) that is connected to the ink discharging holes 44*d*.

Figure 11:
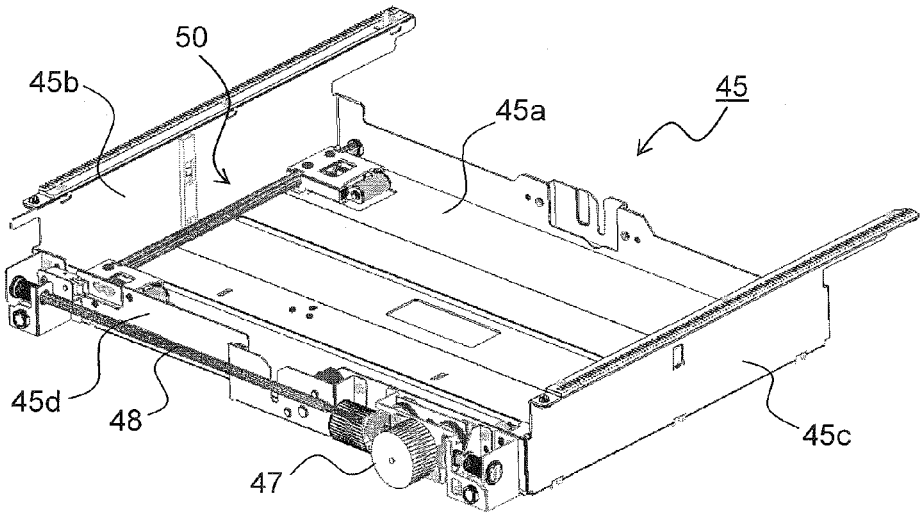
FIG. 11 is a view showing a state in which the wiping mechanism is removed from a unit housing of a maintenance unit.
Figure 12:
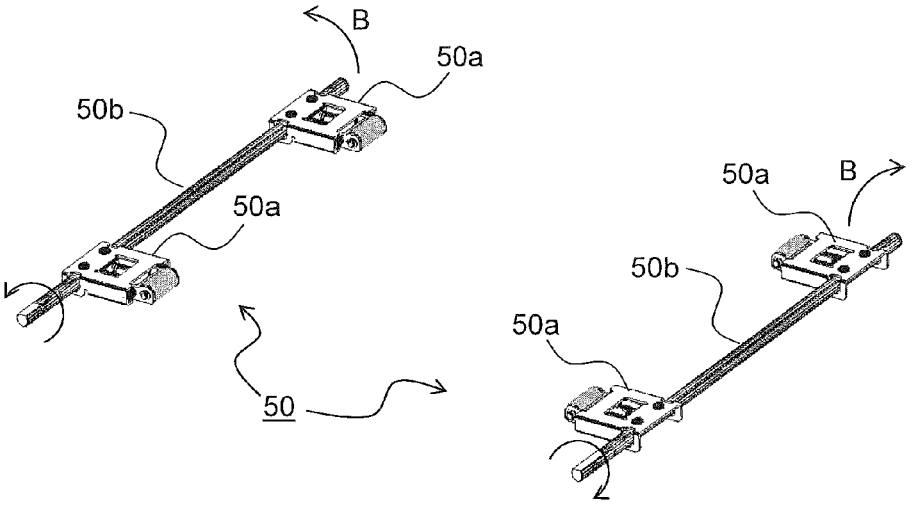
FIG. 12 is a view of a step-up/down mechanism disposed in the unit housing, that is, a view showing a state in which a lift member is in a horizontal state.

Next, a step-up/down mechanism 50 for stepping-up/down the wiping mechanism 30 of the present embodiment is described. The maintenance unit 19 includes a unit housing 45 shown in FIG. 11, the wiping mechanism 30 (see FIG. 6) disposed in the unit housing 45, and the step-up/down mechanism 50 disposed in the unit housing 45. As shown in FIG. 11 and FIG. 12, on a bottom surface 45*a* of the unit housing 45, the step-up/down mechanisms 50, in which two lift members 50*a* are fixed to both ends of a shaft 50, are disposed in pairs along opposing side surfaces 45*b*, 45*c* in the movement direction (arrow AA' direction of FIG. 6) of the carriage 31. In other words, the step-up/down mechanisms 50 are disposed at positions opposing both ends (both upper and lower end portions of FIG. 2) of the recording portion 9 in the width direction of the head housing 10. In the meantime, in FIG. 11, the step-up/down mechanism 50 near the side surface 45*c* is not shown. Besides, a side surface 45*d* of the unit housing 45 abutting the side surfaces 45*b*, 45*c* of the unit housing 45 is provided with a motor 47, and a drive transmission shaft 48 that transmits rotation force of the motor 47 to the shaft 50*b*.

Figure 14:
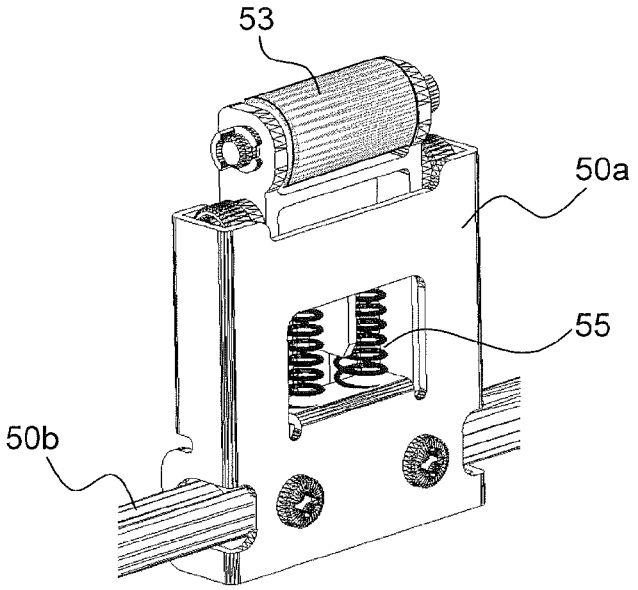
FIG. 14 is a view of the lift member that composes the step-up/down mechanism.

As shown in FIG. 14, a lower end portion of the lift member 50*a* is fixed to the shaft 50*b*, and the lift member 50*a* pivots in accordance with rotation of the shaft 50*b*. A pushing-up roller 53 is rotatably disposed on an upper end portion of the lift member 50*a*. The pushing-up roller 53 is biased by a coil spring 55 in a direction (upward direction of FIG. 14) leaving the shaft 50*b*.

From a state of FIG. 12, when the shaft 50*b* of the right step-up/down mechanism 50 is rotated in a clockwise direction and the shaft 50*b* of the left step-up/down mechanism 50 is rotated in a counterclockwise direction, the lift member 50*a* fallen inside the unit housing 45 rises in an outward direction (arrow B direction), In this way, the lift member 50*a* is switched from a horizontal state to an upright state (state of FIG. 13) to step up the carriage 31 together with the support frame 40.

Figure 13:
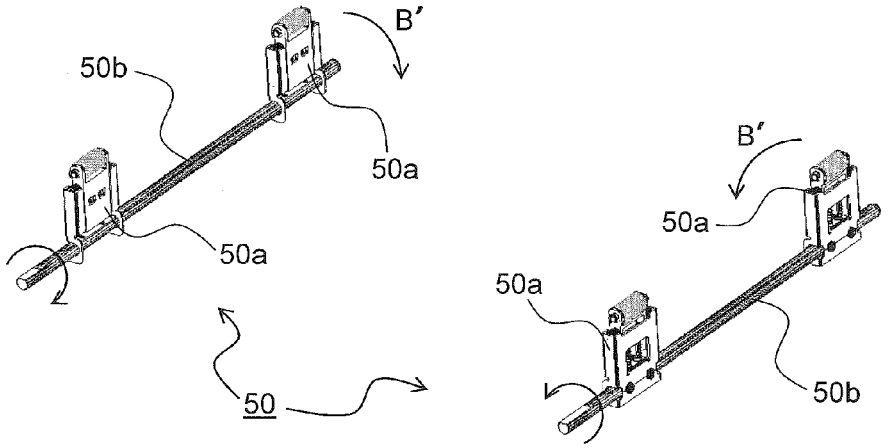
FIG. 13 is a view of the step-up/down mechanism disposed in the unit housing, that is, a view showing a state in which the lift member moves upright from the state of FIG. 12.

On the other hand, from a state of FIG. 13, when the shaft 50*b* of the right step-up/down mechanism 50 is rotated in the counterclockwise direction and the shaft 50*b* of the left step-up/down mechanism 50 is rotated in the clockwise direction, the lift member 50*a* falls in an inward direction (arrow B' direction) of the unit housing 45, In this way, the lift member 50*a* is switched from the upright state to the horizontal state (state of FIG. 12) to step down the carriage 31 together with the support frame 40.

Next, a recovery operation of the recording heads 17*a* to 17*c* by means of the wiping mechanism 30 of the ink-jet recording apparatus 100 according to the present embodiment is described. In the meantime, FIG. 16, FIG. 17, and FIG. 30 each show a state in which the recording portion 9 and the maintenance unit 19 are seen from a downstream side (left of FIG. 15) in the sheet conveyance direction. Besides, the support frame 40 is illustrated like a plate in a simplified manner, and as to the unit housing 45, only the bottom surface 45*a* is illustrated. Besides, the recovery operation of the recording heads 17*a* to 17*c* and the cap unit mounting operation described later are executed by controlling operations of the recording heads 17*a* to 17*c*, wiping mechanism 30, step-up/down mechanism 50 and the like based on control signals from the control portion 110 (see FIG. 1).

Figure 15:
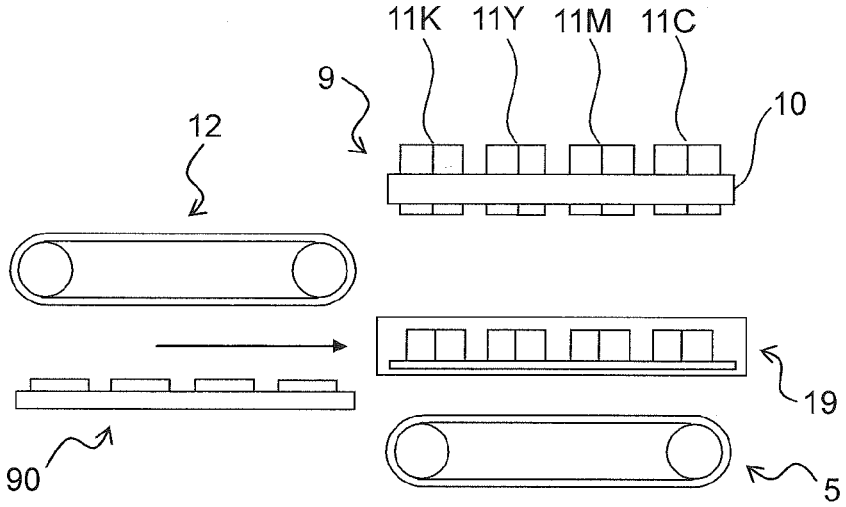
FIG. 15 is a view showing a state in which the maintenance unit is positioned under the recording portion.
Figure 16:
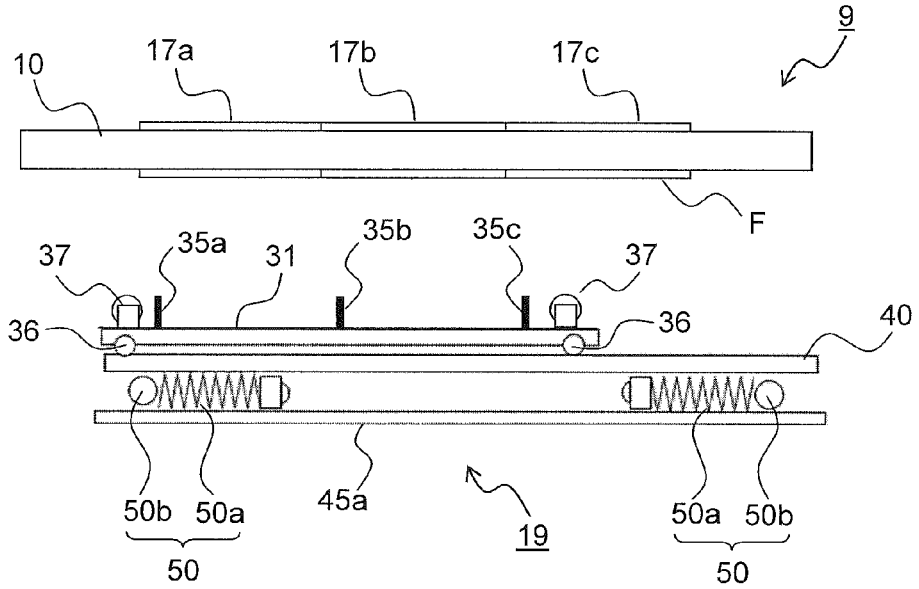
FIG. 16 is a view showing a carriage, the wiper, the support frame, and the step-up/down mechanism in the maintenance unit in the state of FIG. 15.

In a case where the recovery operation of the recording heads 17*a* to 17*c* is performed, first, as shown in FIG. 15, the first conveyance unit 5 located under the recording portion 9 is stepped down. And, the maintenance unit 19 disposed under the second conveyance unit 12 is moved horizontally to be positioned between the recording portion 9 and the first conveyance unit 5. In this state, as shown in FIG. 16, the lift member 50*a* of the step-up/down mechanism 50 is in the horizontal state, and the wipers 35*a* to 35*c* fixed to the carriage 31 are spaced away from the ink ejecting surface F of the recording heads 17*a* to 17*c*.

(First Ink Pushing-Out Operation)

Figure 18:
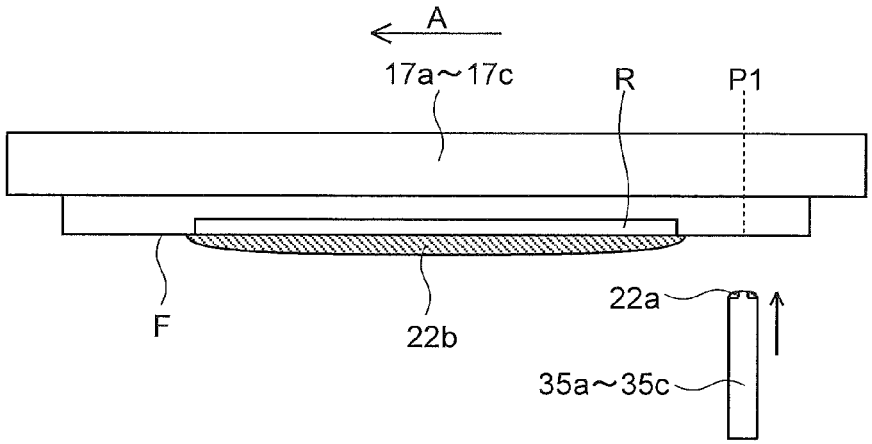
FIG. 18 is a view of the recording head showing a state in which the wiper is positioned under a first position.
Figure 19:
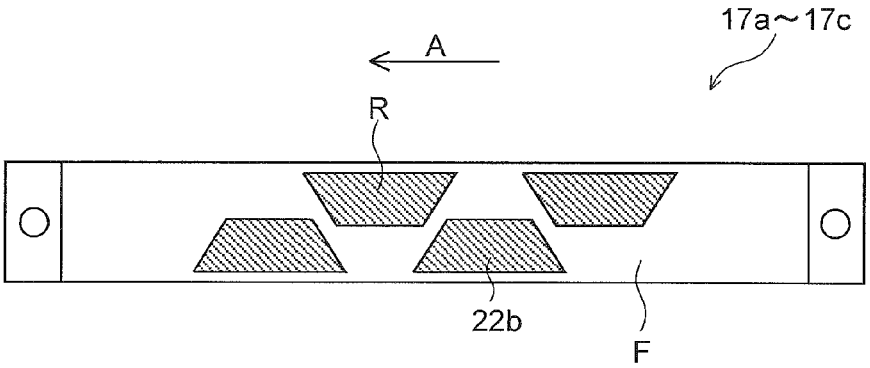
FIG. 19 is a view of the recording head seeing the ink ejecting surface in the state of FIG. 18 from under.

Previous to the wiping operation (first wiping operation described later), the ink 22 is supplied to the recording heads 17*a* to 17*c*. As shown in FIG. 18, the supplied ink 22 is forcibly pushed out (purged) from the ejecting nozzles 18. The ink having high viscosity, foreign matter and air bubbles in the ejecting nozzles 18 are discharged by the purge operation, whereby it is possible to recover the recording heads 17*a* to 17*c*. During this time, as shown in FIG. 19, the purged ink 22 is pushed out onto the ink ejecting surface F along the shape of the nozzle region R where the ejecting nozzles 18 are present.

(First Wiping Operation)

Figure 17:
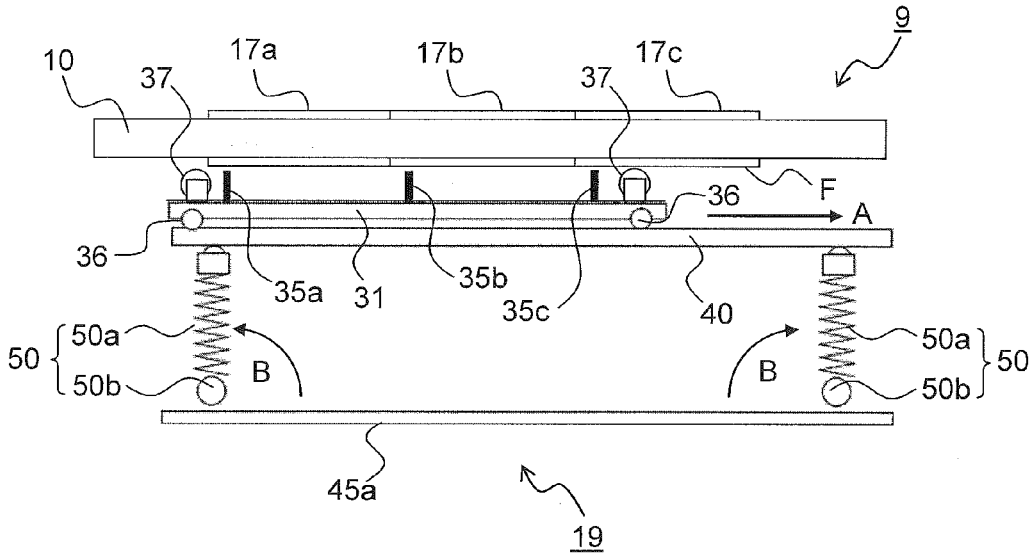
FIG. 17 is a view showing a state in which the support frame and the carriage are stepped up by the step-up/down mechanism from the state of FIG. 16 and the wiper is positioned to abut the ink ejecting surface.

The wipers 35*a* to 35*c* are made to contact a first position P1 of the ink ejecting surface F of the recording heads 17*a* to 17*c* outside the nozzle region R at a predetermined pressure. Specifically, as shown in FIG. 17 and FIG. 18, the shaft 50*b* of the step-up/down mechanism 50 is rotated to make the lift member 50*a* rise upright in the arrow B direction, whereby the support frame 40 and the carriage 31 are stepped up. During this time, gap rollers 37 disposed on the carriage 31 are pressed against a lower surface of the head housing 10 by the bias force of the coil spring 55 (see FIG. 14) of the lift member 50*a*. Accordingly, it is always possible to press the wipers 35*a* to 35*c* against the ink ejecting surface F at a constant pressure.

Figure 20:
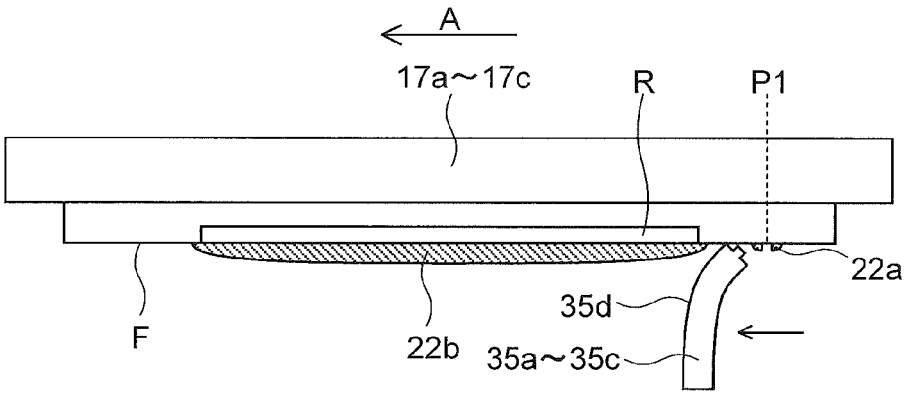
FIG. 20 is a view of the recording head showing a state in which the wiper is moved in an arrow A direction with the wiper pressed against the ink ejecting surface.

From the state in which tip ends of the wipers 35*a* to 35*c* are in tight contact with the ink ejecting surface F, the input gear 43 (see FIG. 6) is rotated forward to move the carriage 31 in the arrow A direction of FIG. 17, whereby also the wipers 35*a* to 35*c* supported by the carriage 31 move, with pressed against the ink ejecting surface F, in the direction (left direction, first direction, arrow A direction) to the nozzle region R along the ink ejecting surface F as shown in FIG. 20. An upward force acts on the support frame 40 by means of the step-up/down mechanism 50. Accordingly, the carriage 31 moves in the arrow A direction while keeping the state in which the gap rollers 37 are pressed against the head housing 10.

At this time, as shown in FIG. 20, the remaining ink 22*a*, which remains on the tip ends (upper surfaces 35*f*) of the wipers 35*a* to 35*c* during the previous recovery operation time of the recording heads and is exposed to air for a long time to become high in viscosity, adheres to the first position P1 of the ink ejecting surface F and leaves the tip ends of the wipers 35*a* to 35*c*.

Figure 21:
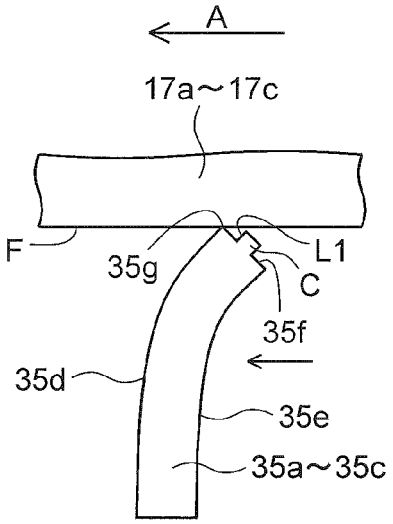
FIG. 21 is a view showing a state of the wiper in which the wiper is being moved in the arrow A direction with pressed against the ink ejecting surface.

In the meantime, as shown in FIG. 21, when the wipers 35*a* to 35*c* move in the arrow A direction in the first wiping operation, the convex portions C (first step portion L1, second step portion L2) do not contact the ink ejecting surface F.

Figure 22:
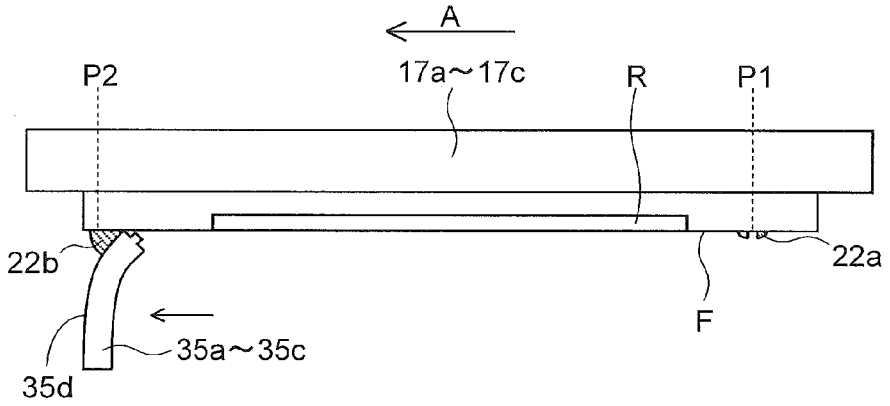
FIG. 22 is a view of the recording head showing a state in which the wiper is moved from the state of FIG. 20 to a second position.

And, as shown in FIG. 22, the wipers 35*a* to 35*c* moves in the left direction (arrow A direction) wiping away the purged ink 22*b* on the ink ejecting surface F, and on arriving at a position (second position P2, left end edge) opposite to the first position P1 with respect to the nozzle region R, the movement in the left direction is stopped. In the meantime, most of the wasted ink wiped away by the wipers 35*a* to 35*c* is collected by the ink collection tray 44 (see FIG. 10).

(Leaving Operation)

Figure 23:
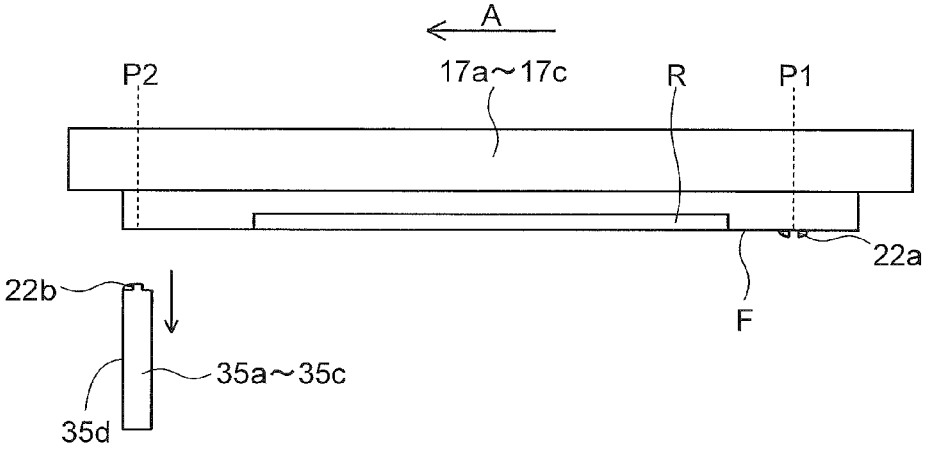
FIG. 23 is a view of the recording head showing a state in which the wiper is made to leave the ink ejecting surface at the second position.

After the execution of the first wiping operation, as shown in FIG. 23, the wipers 35*a* to 35*c* are made to leave the ink ejecting surface F. Specifically, by rotating backward the shaft 50*b* (see FIG. 17) of the step-up/down mechanism 50, the lift member 50*a* is pivoted in the arrow B' direction and brought to the horizontal state, whereby the support frame 40 and the carriage 31 are stepped down. In the meantime, the upper surfaces 35*f* of the wipers 35*a* to 35*c* are each provided thereon with the first step portion L1. Accordingly, it is possible to alleviate the purged ink 22*b* on the first wiping surface 35*d* moving to the second wiping surface 35*e*. Because of this, when making the wipers 35*a* to 35*c* leave the ink ejecting surface F, it is possible to reduce the amount of the purged ink 22*b* that adheres to the upper surfaces 35*f* of the wipers 35*a* to 35*c*. Besides, the upper surfaces 35*f* of the wipers 35*a* to 35*c* are provided thereon with the first step portions L1 and the wipers 35*a* to 35*c* are moved to the left end edge of the ink ejecting surface F in the first wiping operation, whereby when the wipers 35*a* to 35*c* are made to leave the ink ejecting surface F, it is sufficiently possible to alleviate the purged ink 22*b* remaining on the ink ejecting surface F.

(Moving Operation)

Figure 24:
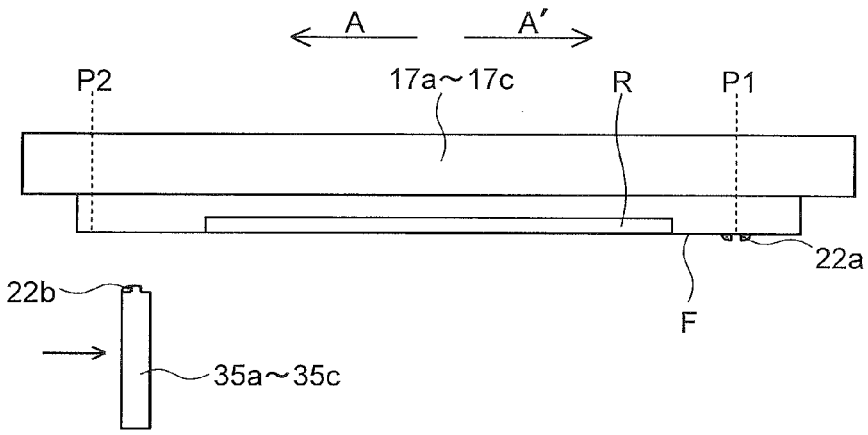
FIG. 24 is a view of the recording head showing a state in which the wiper is moved in an arrow A' direction from the state of FIG. 23.

After the execution of the leaving operation, as shown in FIG. 24, the wipers 35*a* to 35*c* are moved horizontally. Specifically, the input gear 43 (see FIG. 6) is rotated backward from the state of FIG. 23 to move the carriage 31 in the arrow A' direction, whereby as shown in FIG. 24, the wipers 35*a* to 35*c* supported by the carriage 31 move in the same direction (right direction) as the nozzle region R with respect to the second position P2. In the meantime, it is also possible to execute the second wiping operation described later without moving the wipers 35*a* to 35*c* in the right direction, but the wipers 35*a* to 35*c* are moved a little in the right direction, whereby in the second wiping operation, it is possible to alleviate the upper surfaces 35*f* of the wipers 35*a* to 35*c* contacting the left end portion (corner portion) of the ink ejecting surface F and damaging in the second wiping operation.

(Second Ink Pushing-Out Operation)

Figure 25:
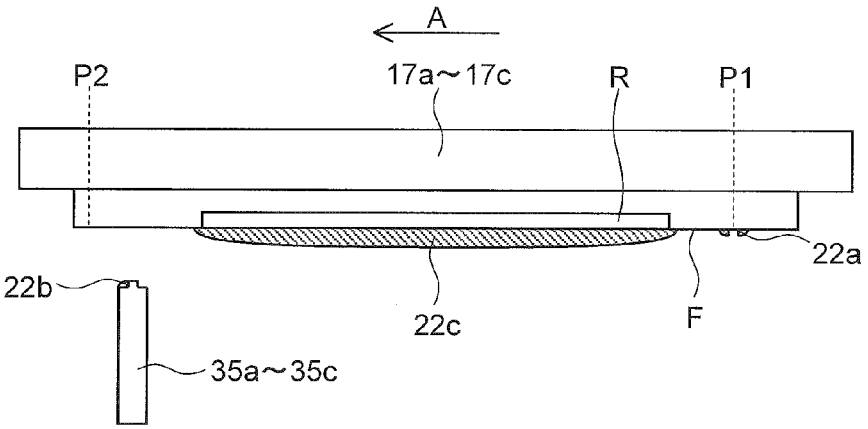
FIG. 25 is a view of the recording head showing a state in which purged ink is pushed out from the state of FIG. 24.

After the execution of the moving operation, the ink 22 is supplied to the recording heads 17*a* to 17*c*. As shown in FIG. 25, the supplied ink 22 is forcibly pushed out (purged) from the ink ejecting nozzles 18. In this way, like the first ink pushing-out operation, the purged ink 22*c* adheres to the ink ejecting surface F.

(Second Wiping Operation)

Figure 26:
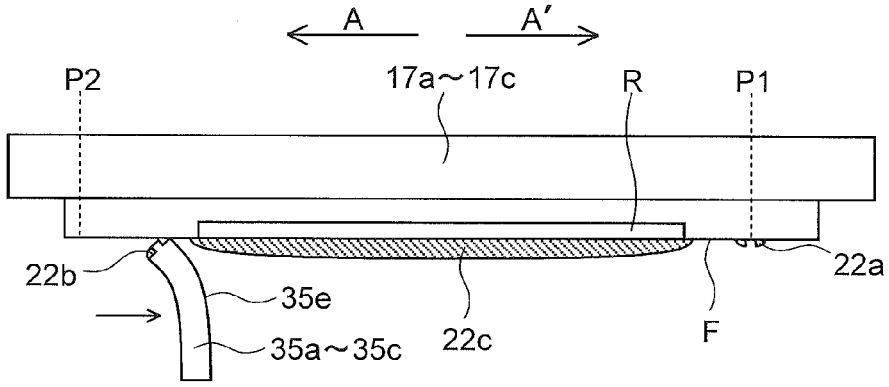
FIG. 26 is a view of the recording head showing a state in which the wiper is pressed against the ink ejecting surface, thereafter, moved in the arrow A' direction from the state of FIG. 25.

Thereafter, a wiping operation is performed which wipes away the purged ink 22*c* and remaining ink 22*a* on the ink ejecting surface F. Specifically, the shaft 50*b* of the step-up/down mechanism 50 is rotated to make the lift member 50*a* rise upright in the arrow B direction, whereby the support frame 40 and the carriage 31 are stepped up. In this way, the wipers 35*a* to 35*c* are made to contact a left position of the ink ejecting surface F of the recording heads 17*a* to 17*c* with respect to the nozzle region R at a predetermined pressure. And, the input gear 43 (see FIG. 6) is rotated backward to move the carriage 31 in the arrow A' direction (right direction, second direction), whereby as shown in FIG. 26, the wipers 35*a* to 35*c* move in a direction (right direction) to the nozzle region R along the ink ejecting surface F with the wipers 35*a* to 35*c* pressed against the ink ejecting surface F.

Figure 27:
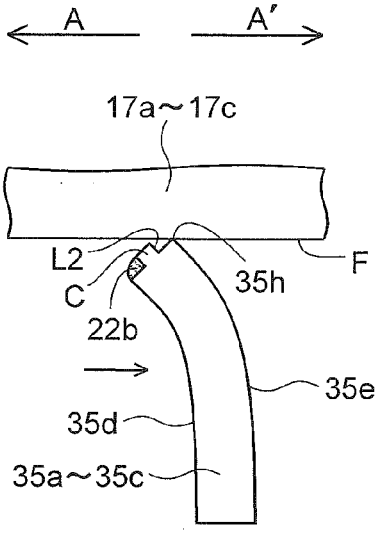
FIG. 27 is a view showing a state of the wiper in which the wiper is being moved in the arrow A' direction with pressed against the ink ejecting surface.

In the meantime, as shown in FIG. 27, in the second wiping operation, when the wipers 35*a* to 35*c* move in the arrow A' direction, the convex portions C (first step portion L1, second step portion L2) do not contact the ink ejecting surface F.

Figure 28:
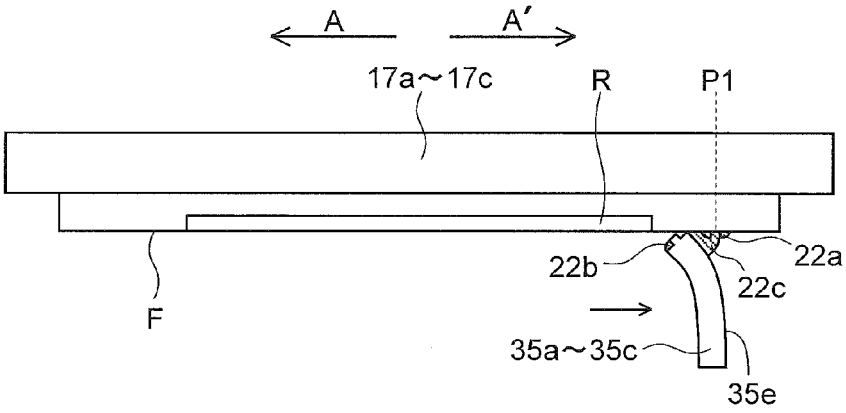
FIG. 28 is a view of the recording head showing a state in which the wiper is further moved in the arrow A' direction from the state of FIG. 26 and the purged ink contacts remaining ink.

And, the purged ink 22*c* pushed out by the second ink pushing-out operation and the remaining ink 22*a* adhering to the first position P1 are wiped away. At this time, as shown in FIG. 28, when the purged ink 22*c* wiped away by the wipers 35*a* to 35*c* contacts the remaining ink 22*a*, the remaining ink 22*a* merges into the purged ink 22*c* and the viscosity of the remaining ink 22*a* declines.

Figure 29:
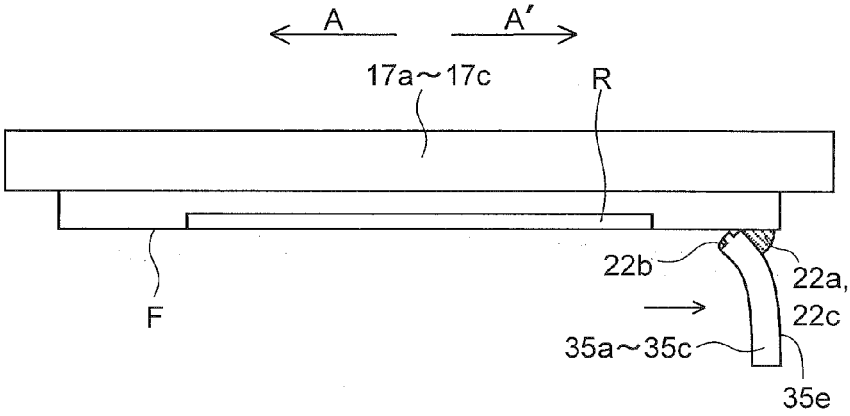
FIG. 29 is a view of the recording head showing a state in which the wiper is moved from the state of FIG. 28 to an end edge on a downstream side in the arrow A' direction.
Figure 30:
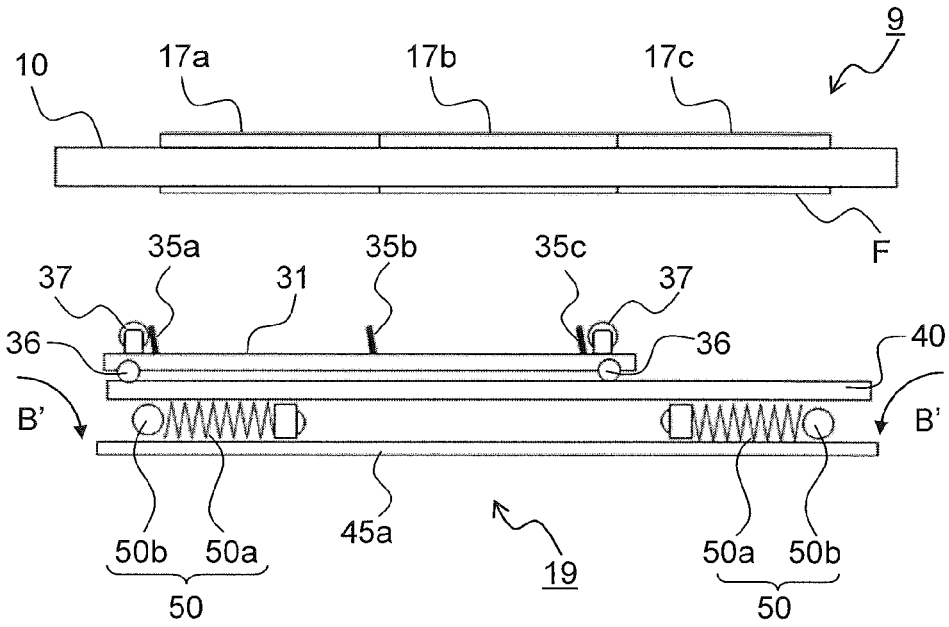
FIG. 30 is a view showing a state in which the support frame and the carriage are stepped down by the step-up/down mechanism and the wiper leaves the ink ejecting surface.

Thereafter, the wipers 35*a* to 35*c* each move to an end edge (right end edge of FIG. 29) of the ink ejecting surface F of the recording heads 17*a* to 17*c*, and most of the wasted ink wiped away by the wipers 35*a* to 35*c* flows down to be collected by the ink collection tray 44 (see FIG. 10). And, as shown in FIG. 30, the shaft 50*b* of the step-up/down mechanism 50 is rotated to make the lift member 50*a* fall in the arrow B' direction, whereby the wipers 35*a* to 35*c* are evacuated downward from the ink ejecting surface F of the recording heads 17*a* to 17*c* to return the maintenance unit 19 to the state of FIG. 16.

Figure 31:
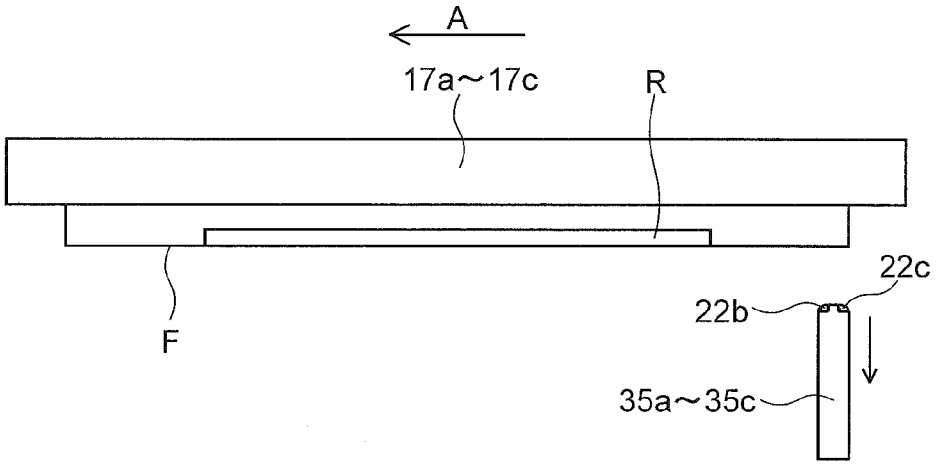
FIG. 31 is a view of the recording head showing a state in which the wiper is made to leave the ink ejecting surface.

In the meantime, as shown in FIG. 9, the upper surfaces 35*f* of the wipers 35*a* to 35*c* are each provided with the second step portion L2. Accordingly, as shown in FIG. 31, it is possible to alleviate the purged ink 22*c* on the second wiping surface 35*e* moving to the first wiping surface 35*d*. Because of this, when the wipers 35*a* to 35*c* are made to leave the ink ejecting surface F, it is possible to reduce the amount of the purged ink 22*c* that adheres to the upper surfaces 35*f* of the wipers 35*a* to 35*c*. Besides, the upper surfaces 35*f* of the wipers 35*a* to 35*c* are provided thereon with the second step portions L2 and in the second wiping operation, the wipers 35*a* to 35*c* are moved to the right end edge of the ink ejecting surface F, whereby when the wipers 35*a* to 35*c* are made to leave the ink ejecting surface F, it is possible to sufficiently alleviate the purged ink 22*c* remaining on the ink ejecting surface F.

Lastly, the maintenance unit 19 positioned between the recording portion 9 and the first conveyance unit 5 is moved horizontally to be positioned under the second conveyance unit 12, and the first conveyance unit 5 is stepped up to a predetermined position to end the recovery operation of the recording heads 17*a* to 17*c*.

In a case where the cap unit 90 is mounted onto the recording heads 17*a* to 17*c*, first, as shown in FIG. 15, the first belt conveyance portion 5 disposed to oppose a lower surface of the recoding portion 9 is stepped down. And, the cap unit 90 disposed under the second belt conveyance portion 12 is moved horizontally into between the recording portion 9 and the first belt conveyance portion 5 to be positioned at a position opposing the recording portion 9.

Next, the first belt conveyance portion 5 is stepped up, whereby the cap unit 90 is pushed up. And, at a time the cap unit 90 comes into tight contact with the recording heads 17*a* to 17*c*, the stepping-up of the first belt conveyance portion 5 is stopped to complete the mounting of the cap unit 90.

In the present embodiment, as described above, after the execution of the first wiping operation, by executing the second wiping operation in which the wipers 35*a* to 35*c* are moved along the ink ejecting surface F from the position opposite to the first position P1 with respect to the nozzle region R to the position on the first position P1 side with respect to the nozzle region R, it is possible to wipe away the remaining ink 22*a* adhering to the first position P1 by means of the wipers 35*a* to 35*c*. In this way, it is possible to alleviate the remaining ink 22*a* collecting on the ink ejecting surface F. Accordingly, it is possible to alleviate a large ink puddle forming. Besides, unlike the case of disposing the two wipers 35*a* to 35*c* that successively contact the ink ejecting surface F (the ink-jet recording apparatus that has the above two wipers), it is possible to alleviate the number of the wipers 35*a* to 35*c* increasing. Accordingly, it is possible to alleviate a structure of the recovery system for the recording heads 17*a* to 17*c* becoming complicated.

Besides, the upper surfaces 35*f* of the wipers 35*a* to 35*c* are each provided thereon with the convex portion C, and the first step portion L1, which becomes higher in the direction from the first upper end portion 35*g* to the second upper end portion 35*h*, is formed between the first upper end portion 35*g* and the convex portion C. In this way, it is possible to alleviate the ink 22 moving in the direction from the first upper end portion 35*g* to the second upper end portion 35*h* by means of the first step portion L1. Accordingly, it is possible to alleviate the ink 22, which is wiped away by the first wiping surface 35*d*, adhering to the second upper end portion 35*h*. Because of this, at the start time of the second wiping operation, it is possible to alleviate the ink 22 on the second upper end portion 35*h* being stretched and adhering to the ink ejecting surface F. In the meantime, in a case where only a small amount of the ink 22 adheres to the second upper end portion 35*h*, if the second wiping operation is executed, the ink 22 is stretched to adhere to the ink ejecting surface F, and some amount of the ink is not wiped away and left.

Besides, the upper surfaces 35*f* of the wipers 35*a* to 35*c* are each provided thereon with the first step portion L1, whereby during the leaving operation time after the first wiping operation, it is possible to reduce the amount of the ink 22 that adheres to the upper surfaces 35*f* of the wipers 35*a* to 35*c* and to the ink ejecting surface F.

Besides, as described above, when the wiper 35*a* to 35*c* move in the arrow A direction (left direction) in the first wiping operation, the first step portions L1 do not contact the ink ejecting surface F. In this way, only the first upper end portions 35*g* contact the ink ejecting surface F. Accordingly, it is possible to alleviate a contact pressure of the first upper end portion 35*g* against the ink ejecting surface F changing.

Besides, as described above, the upper surfaces 35*f* are each provided thereon with the second step portion L2, which becomes lower in the direction from the first upper end portion 35*g* to the second upper end portion 35*h*, between the convex portion C and the second upper end portion 35*h*. In this way, it is possible to alleviate the ink 22 moving from the second upper end portion 35*h* to the first upper end portion 35*g* by means of the second step portion L2. Because of this, during the leaving operation time after the second wiping operation, it is possible to reduce the amount of the ink 22 that adheres to the upper surfaces 35*f* of the wipers 35*a* to 35*c* and to the ink ejecting surface F.

Besides, as described above, when the wiper 35*a* to 35*c* move in the arrow A' direction (right direction) in the second wiping operation, the second step portions L2 do not contact the ink ejecting surface F. In this way, only the second upper end portions 35*h* contact the ink ejecting surface F. Accordingly, it is possible to alleviate a contact pressure of the second upper end portion 35*h* against the ink ejecting surface F changing.

Besides, as described above, in the second wiping operation, the wipers 35*a* to 35*c* are moved in the arrow A' direction (right direction), whereby the wipers 35*a* to 35*c* wipe away the purged ink 22*c* pushed out during the second ink pushing-out operation time, thereafter, wipe away the remaining ink 22*a* adhering to the first position P1. In this way, when the wipers 35*a* to 35*c* wipe away the remaining ink 22*a*, the purged ink 22*c*, which is not high in viscosity, contacts the remaining ink 22*a* that is exposed to air for a long time to become high in viscosity. Accordingly, the remaining ink 22*a* merges into the purged ink 22*b* and the viscosity of the remaining ink 22*a* declines. Because of this, in the second wiping operation, it is possible to make it easy for the wipers 35*a* to 35*c* to wipe away the remaining ink 22*a* that adheres to the ink ejecting surface F.

Besides, as described above, after the execution of the first wiping operation, the leaving operation is executed which makes the wipers 35*a* to 35*c* leave the ink ejecting surface F. In this way, it is possible to temporarily eliminate bends (deformations) of the wipers 35*a* to 35*c* by means of the leaving operation. Accordingly, it is possible to easily press the second upper end portions 35*h* of the second wiping surfaces 35*e* of the wipers 35*a* to 35*c* against the ink ejecting surface F.

(Second Embodiment)

Figure 32:
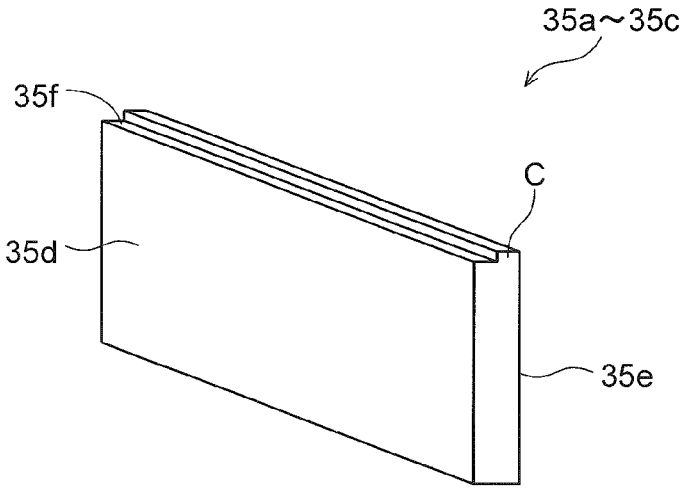
FIG. 32 is a view showing a wiper used in an ink-jet recording apparatus according to a second embodiment of the present disclosure.
Figure 33:
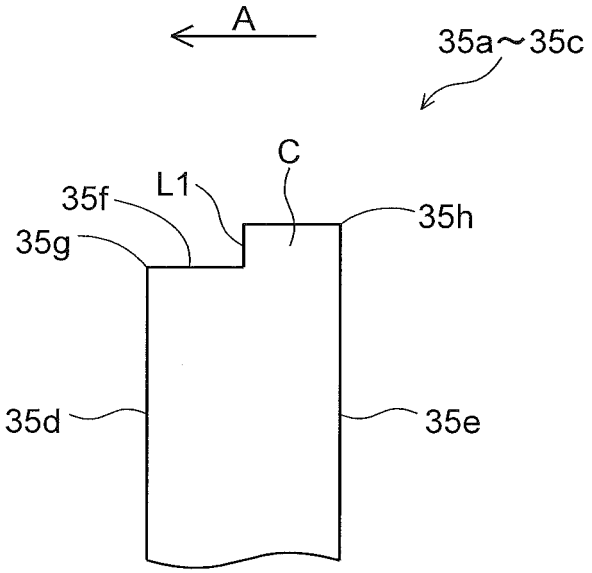
FIG. 33 is a view showing, from a wiper width direction, a structure of an upper portion of the wiper used in the ink-jet recording apparatus according to the second embodiment of the present disclosure.

Next, with reference to FIG. 32 and FIG. 33, the wipers 35*a* to 35*c*, which are used in the ink-jet recording apparatus 100 according to a second embodiment of the present disclosure, are described.

In the second embodiment of the present disclosure, as shown in FIG. 32 and FIG. 33, like the above first embodiment, the wipers 35*a* to 35*c* each include the first wiping surface 35*d*, the second wiping surface 35*e*, and the upper surface 35*f*.

The upper surface 35*f* is provided thereon with the convex portion C which is rectangular in a side view. In the second embodiment, the convex portion C is formed to be coplanar with the second wiping surface 35*e*, and the first step portion L1, which becomes higher in the direction from the first upper end portion 35*g* to the second upper end portion 35*h*, is formed between the first upper end portion 35*g* and the convex portion C. In the meantime, when the wiper 35*a* to 35*c* move in the arrow A direction in the first wiping operation, the convex portions C (first step portion L1) do not contact the ink ejecting surface F.

For example, the wipers 35*a* to 35*c* are each formed to have a width of about 2.5 mm when seeing from the arrow A direction and a width (distance between the first wiping surface 35*d* and the second wiping surface 35*e*) of about 1.5 mm in a cross-sectional view. Besides, the convex portion C is formed into a square that has an edge length of about 0.5 mm in a cross-sectional view. In other words, the distance between the first upper end portion 35*g* and the first step portion L1 is about 1.0 mm, and the height of the first step portion L1 is about 0.5 mm.

The other structures of the second embodiment and the recovery operation of the recording heads 17*a* to 17*c* are the same as the first embodiment.

In the present embodiment, as described above, the convex portions C of the wipers 35*a* to 35*c* are formed to be coplanar with the second wiping surfaces 35*e*. Even in this case, it is possible to alleviate the ink 22 moving in the direction from the first upper end portion 35*g* to the second upper end portion 35*h* by means of the first step portion L1. Accordingly, it is possible to alleviate the ink 22, which is wiped away by the first wiping surface 35*d*, adhering to the second upper end portion 35*h*. Besides, it is possible to reduce the amount of the ink 22 which adheres to the upper surfaces 35*f* of the wipers 35*a* to 35*c* and to the ink ejecting surface F.

The other effects of the second embodiment are the same as the first embodiment.

(Third Embodiment)

Figure 34:
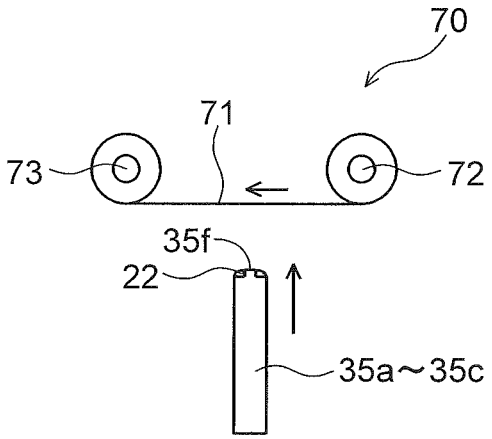
FIG. 34 is a view showing a structure of a cleaning mechanism disposed in an ink-jet recording apparatus according to a third embodiment of the present disclosure.
Figure 35A:
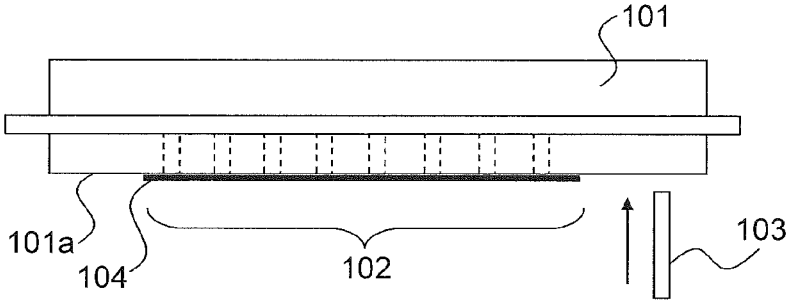
FIG.35A PRIOR ART
FIG. 35A is a view showing a conventional wiping mechanism that makes a wiper contact an ink ejecting surface at a predetermined contact pressure from a substantially perpendicular direction and cleans the ink ejecting surface of a recording head, that is, a view showing a state in which the wiper is positioned under a wiping start position.
Figure 35B:
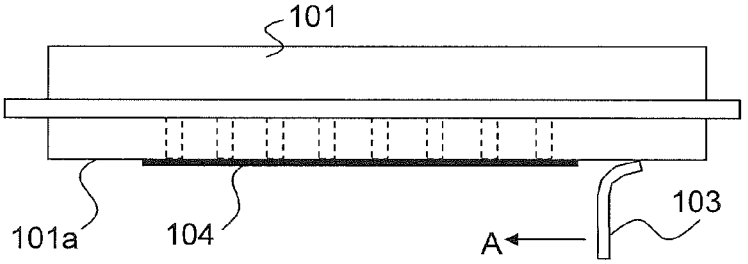
FIG.35B PRIOR ART
FIG. 35B is a view of the recording head showing a state in which the wiper is moved from the state of FIG. 35A to a nozzle region while making the wiper contact the ink ejecting surface.
Figure 35C:
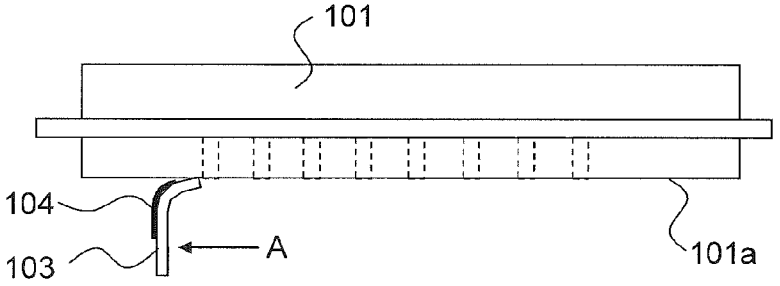
FIG.35C PRIOR ART
FIG. 35C is a view of the recording head showing a state in which the wiper is further moved from the state of FIG. 35B to pass through the nozzle region.
Figure 35D:
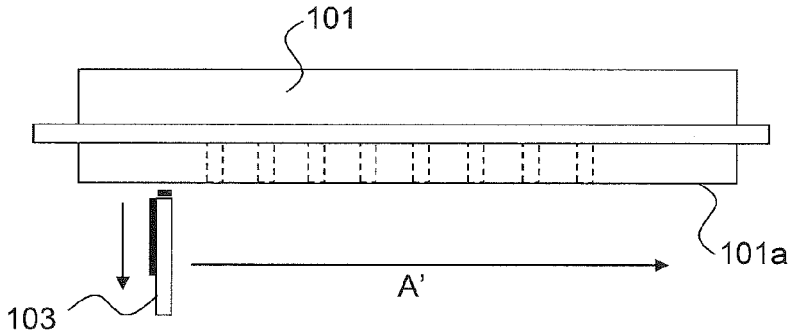
FIG.35D PRIOR ART
FIG. 35D is a view of the recording head showing a state in which the wiper is made to leave the ink ejecting surface from the state of FIG. 35C.
Figure 36A:
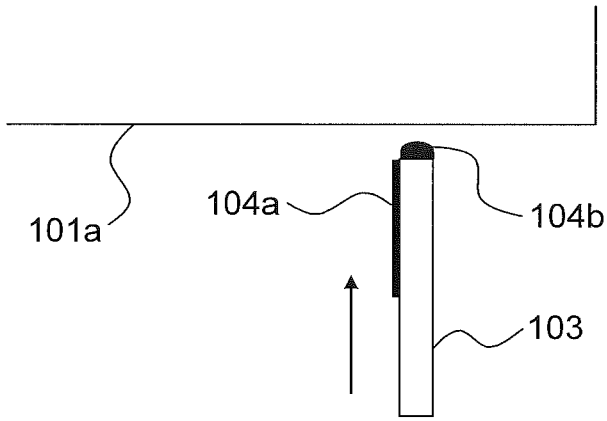
FIG.36A PRIOR ART
FIG. 36A is a view of the recording head showing a state in which the wiper is positioned under the wiping start position to perform a second wiping by using the conventional wiping mechanism shown in FIG. 35A.
Figure 36B:
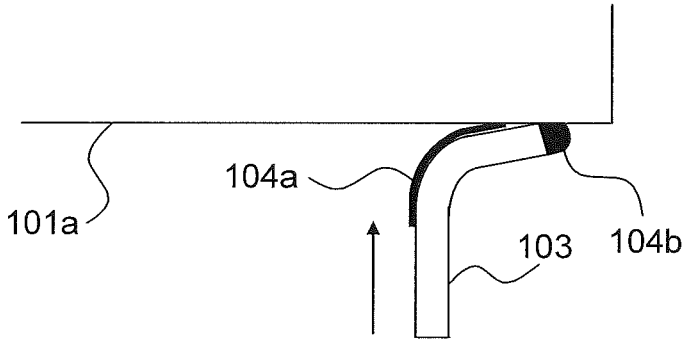
FIG.36B PRIOR ART
FIG. 36B is a view of the recording head showing a state in which the wiper is made to contact the ink ejecting surface from the state of FIG. 36A.
Figure 36C:
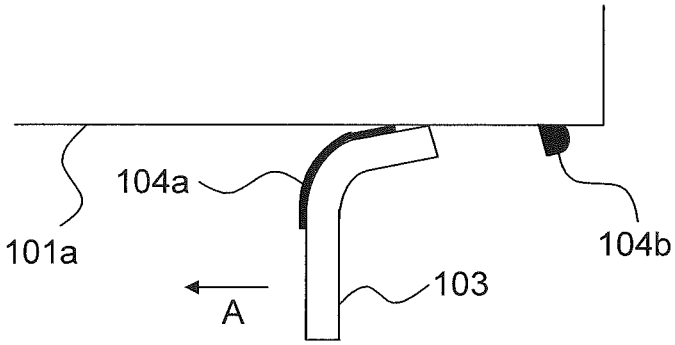
FIG.36C PRIOR ART
FIG. 36C is a view of the recording head showing a state in which the wiper is moved from the state of FIG. 36B toward the nozzle region while making the wiper contact the ink ejecting surface.

Next, with reference to FIG. 34, the ink-jet recording apparatus 100 according to a third embodiment of the present disclosure is described.

In the third embodiment of the present disclosure, as shown in FIG. 34, the ink-jet recording apparatus 100 includes a cleaning mechanism 70 that cleans the upper surfaces 35*f* of the wipers 35*a* to 35*c*. The cleaning mechanism 70 includes: a cleaning member 71 which is formed of a fiber web and the like and to which the ink 22 adhering to the upper surfaces 35*f* of the wipers 35*a* to 35*c* is transferred; a sending roller 72 around which the cleaning member 71 is wound; and a winding roller 73 that winds the cleaning member 71 sent out from the sending roller 72.

Besides, in the third embodiment, after the execution of the second wiping operation of the recovery operation of the recording heads 17*a* to 17*c*, the upper surfaces 35*f* of the wipers 35*a* to 35*c* are made to contact and leave the cleaning member 71 a plurality of times, whereby the ink 22 on the upper surfaces 35*f* of the wipers 35*a* to 35*c* is absorbed by the cleaning member 71. In the meantime, in a case where the absorbing power of the cleaning member 71 declines, the winding roller 73 is rotated to enable the upper surfaces 35*f* of the wipers 35*a* to 35*c* to abut a clean transfer surface of the cleaning member 71, whereby it is possible to recover the absorbing power of the cleaning member 71. Accordingly, it is possible to sufficiently clean the upper surfaces 35*f* of the wipers 35*a* to 35*c*.

The other structures of the third embodiment and the other recovery operation of the recording heads 17*a* to 17*c* are the same as the second embodiment.

In the present embodiment, as described above, the cleaning mechanism 70 is disposed which cleans the upper surfaces 35*f* of the wipers 35*a* to 35*c*. In this way, it is possible to remove the ink 22 on the upper surfaces 35*f* of the wipers 35*a* to 35*c*. Accordingly, it is possible to alleviate the ink 22, which adheres to the wipers 35*a* to 35*c*, adhering to the ink ejecting surface F during the next recovery operation time.

The other effects of the third embodiment are the same as the second embodiment.

It should be considered that the embodiments disclosed this time are examples in all respects and are not limiting. The scope of the present disclosure is not indicated by the above description of the embodiments but by the claims, and all modifications within the scope of the claims and the meaning equivalent to the claims are covered.

For example, in the above embodiments, the first ink pushing-out operation is executed before the first wiping operation, but if it is before the wipers 35*a* to 35*c* enter the nozzle region R, the first ink pushing-out operation may be executed at the same time as the first wiping operation.

Besides, in the above embodiments, the second ink pushing-out operation is executed after the leaving operation, but may be executed before the leaving operation, and if it is before the wipers 35*a* to 35*c* enter the nozzle region R, the second ink pushing-out operation may be executed at the same time as the second wiping operation.

Besides, for example, in the above first embodiment, the example is described, in which the convex portions C of the wipers 35*a* to 35*c* are formed not to contact the ink ejecting surface F when the wipers 35*a* to 35*c* move in the arrow AA' direction in the first wiping operation and second wiping operation, but the present disclosure is not limited to this. For example, the wipers 35*a* to 35*c* may be formed in such a manner that both the first upper end portion 35*g* and the convex portion C (first step portion L1) contact the ink ejecting surface F when the wipers 35*a* to 35*c* move in the A' direction in the first wiping operation. Besides, the wipers 35*a* to 35*c* may be formed in such a manner that both the second upper end portion 35*h* and the convex portion C (second step portion L2) contact the ink ejecting surface F when the wipers 35*a* to 35*c* move in the A' direction in the second wiping operation. However, to alleviate the contact pressure of the first upper end portion 35*g* and second upper end portion 35*h* against the ink ejecting surface F changing, it is preferable to form the wipers 35*a* to 35*c* in such a manner that the convex portion C does not contact the ink ejecting surface F when the wipers 35*a* to 35*c* move in the AA' direction in the first wiping operation and second wiping operation.

Besides, as to the drive mechanism (rack teeth 38, input gear 43) and the step-up/down mechanism 50, it is possible to use another conventionally known drive mechanism and step-up/down mechanism. It is also possible to suitably set the number of the ejecting nozzles 18 of the recording heads 17*a* to 17*c*, the nozzle interval and the like in accordance with the specifications of the ink-jet recording apparatus 100. Besides, the number of recording heads is not especially limited, and for example, it is also possible to dispose the recording head 17 one, two, four or more for each line head 11C to 11K.

Besides, the present disclosure is also applicable to an ink-jet recording apparatus for single color printing that includes only one of the line heads 11C to 11K. In this case, the recording heads 17*a* to 17*c* are each disposed one. Accordingly, also the wipers 35*a* to 35*c* each may be fixed one to the carriage 31.

What is claimed is:

1. A recovery system for a recording head that is provided with a nozzle region from which an ejecting nozzle for ejecting ink onto a recording medium is opened, comprising:

a wiper that wipes away purged ink which is forcibly pushed out form the ejecting nozzle, a drive mechanism that reciprocates the wiper along an ink ejecting surface including the nozzle region, and a control portion that controls pushing-out, ejection of the ink from the ejecting nozzle and operation of the drive mechanism, wherein the control portion is able to execute a recording head recovery operation that includes: a first ink pushing-out operation that forcibly pushes out the ink from the ejecting nozzle and makes the purged ink adhere to the nozzle region; a first wiping operation that presses the wiper against a first position outside the nozzle region of the ink ejecting surface, thereafter, moves the wiper to the nozzle region in a first direction along the ink ejecting surface with the wiper pressed against the ink ejecting surface, thereby wipes away the purged ink, and moves the wiper to a second position opposite to the first position with respect to the nozzle region; and a second wiping operation that moves the wiper from a position opposite to the first position with respect to the nozzle region to a position on the first position side with respect to the nozzle region with the wiper pressed against the ink ejecting surface, the wiper includes: a first wiping surface disposed to face in the first direction; a second wiping surface disposed to face in a second direction opposite to the first direction; and an upper surface disposed between the first wiping surface and the second wiping surface, the first wiping surface includes a first upper end portion that contacts the ink ejecting surface when the wiper moves in the first direction in the first wiping operation, the second wiping surface includes a second upper end portion that contacts the ink ejecting surface when the wiper moves in the second direction in the second wiping operation, the upper surface is provided with a convex portion, which is rectangular in a side view, between the first upper end portion and the second upper end portion, and is provided with a first step portion, which becomes higher from the first upper end portion to the second upper end portion, between the first upper end portion and the convex portion, and is provided with a second step portion, which becomes lower from the first upper end portion to the second upper end portion, between the convex portion and the second upper end portion, and the first upper end portion, the first step portion, the convex portion, the second step portion, and the second upper end portion are arranged in this order.

2. The recovery system for the recording head according to claim 1, wherein the first step portion does not contact the ink ejecting surface when the wiper moves in the first direction in the first wiping operation.

3. The recovery system for the recording head according to claim 1, wherein the second step portion does not contact the ink ejecting surface when the wiper moves in the second direction in the second wiping operation.

4. The recovery system for the recording head according to claim 1, wherein the control portion, after execution of the first wiping operation, executes a second ink pushing-out operation that forcibly pushes out the ink from the ejecting nozzle and makes the purged ink adhere to the nozzle region, and the control portion, during a time of the second wiping operation, moves the wiper in the second direction along the ink ejecting surface with the wiper pressed against the ink ejecting surface and thereby wipes away the purged ink that is pushed out during a time of the second ink pushing-out operation.

5. The recovery system for the recording head according to claim 1, wherein the control portion, after execution of the first wiping operation, executes a leaving operation that makes the wiper leave the ink ejecting surface.

6. An ink-jet recording apparatus comprising the recovery system for the recording head according to claim 1.

7. The recovery system for the recording head according to claim 4, wherein in the second wiping operation, the wiper wipes away remaining ink that the wiper has left adhered when contacting the first position.

8. The recovery system for the recording head according to claim 7, wherein in the second wiping operation, the wiper makes the remaining ink contact the purged ink pushed out in the second ink pushing-out operation, and makes the remaining ink merge into the purged ink pushed out in the second ink pushing-out operation.

9. The recovery system for the recording head according to claim 5, wherein after the leaving operation, the control portion makes the wiper move in the second direction, presses the wiper against the ink ejecting surface, at a position between the second position and the nozzle region, and then performs the second wiping operation.

* * * * *